US007820928B2

(12) United States Patent
Simon

(10) Patent No.: US 7,820,928 B2
(45) Date of Patent: Oct. 26, 2010

(54) REMOTE SWITCH ACTUATOR

(76) Inventor: Paul John Simon, W 250 CTH CCC, Gleason, WI (US) 54435

( * ) Notice: Subject to any disclaimer, the term of this patent is extended or adjusted under 35 U.S.C. 154(b) by 260 days.

(21) Appl. No.: 12/069,658

(22) Filed: Feb. 11, 2008

(65) Prior Publication Data

US 2008/0202908 A1 Aug. 28, 2008

Related U.S. Application Data

(60) Provisional application No. 60/900,706, filed on Feb. 12, 2007.

(51) Int. Cl.
*H01H 17/00* (2006.01)

(52) U.S. Cl. ..... 200/331

(58) Field of Classification Search ..... 200/331, 200/1 B, 318, 334, 337, 339
See application file for complete search history.

(56) References Cited

U.S. PATENT DOCUMENTS 2,646,487 A * 7/1953 Johnson ..... 200/331
4,085,337 A * 4/1978 Moeller ..... 307/115
5,023,417 A * 6/1991 Magiera ..... 200/331

* cited by examiner

*Primary Examiner*—Edwin A. Leon

(57) ABSTRACT

A remote switch actuator assembly includes a handle bar, a first actuator lever mounted to the handle bar, a mounting bracket configured to secure a drill to the handle bar such that a chuck end of the drill faces the handle bar, a second actuator lever secured to the mounting bracket so as to be in proximity with an actuation switch of the drill when the drill is secured by the mounting bracket, and a cable extending between and coupled with the first actuator lever and the second actuator lever. The first actuator lever is movable with respect to the handle bar to effect movement of the cable and corresponding movement of the second actuator lever toward the mounting bracket and the actuation switch of the drill when the drill is secured by the mounting bracket, and movement of the second actuator lever facilitates actuation of the drill secured by the mounting bracket by engaging with the actuation switch of the drill in response to movement of the first actuator lever.

5 Claims, 2 Drawing Sheets

REMOTE SWITCH ACTUATOR

CROSS-REFERENCE TO RELATED APPLICATION

This application claims priority from U.S. Provisional Patent Application Ser. No. 60/900,706, filed Feb. 12, 2007, entitled the Arm Saver. The disclosure of this provisional patent application is incorporated herein by reference in its entirety.

BACKGROUND

Hand augers are used to drill holes in the ice for ice fishing. It is desired to provide a mechanism to assist in drilling the holes in the ice.

SUMMARY OF THE INVENTION

In accordance with an embodiment of the invention, a remote switch actuator assembly comprises a handle bar, a first actuator lever mounted to the handle bar, a mounting bracket configured to secure a drill to the handle bar such that a chuck end of the drill faces the handle bar, a second actuator lever secured to the mounting bracket so as to be in proximity with an actuation switch of the drill when the drill is secured by the mounting bracket, and a cable extending between and coupled with the first actuator lever and the second actuator lever. The first actuator lever is movable with respect to the handle bar to effect movement of the cable and corresponding movement of the second actuator lever toward the mounting bracket and the actuation switch of the drill when the drill is secured by the mounting bracket, and movement of the second actuator lever facilitates actuation of the drill secured by the mounting bracket by engaging with the actuation switch of the drill in response to movement of the first actuator lever.

The above and still further objects, features and advantages of the present invention will become apparent upon consideration of the following definitions, descriptions and descriptive figures of an embodiment thereof, wherein like reference numerals in the various figures are utilized to designate like components.

DETAILED DESCRIPTION

As shown in the figures, a remote actuator device comprises a handle bar end that couples with a rotary tool such as an auger and a drill end that includes a clamping structure, where the handle bar includes an actuator lever that can be controlled by the user to remotely actuate a drill when the drill is secured at the drill end with the clamping structure.

Figure 1:
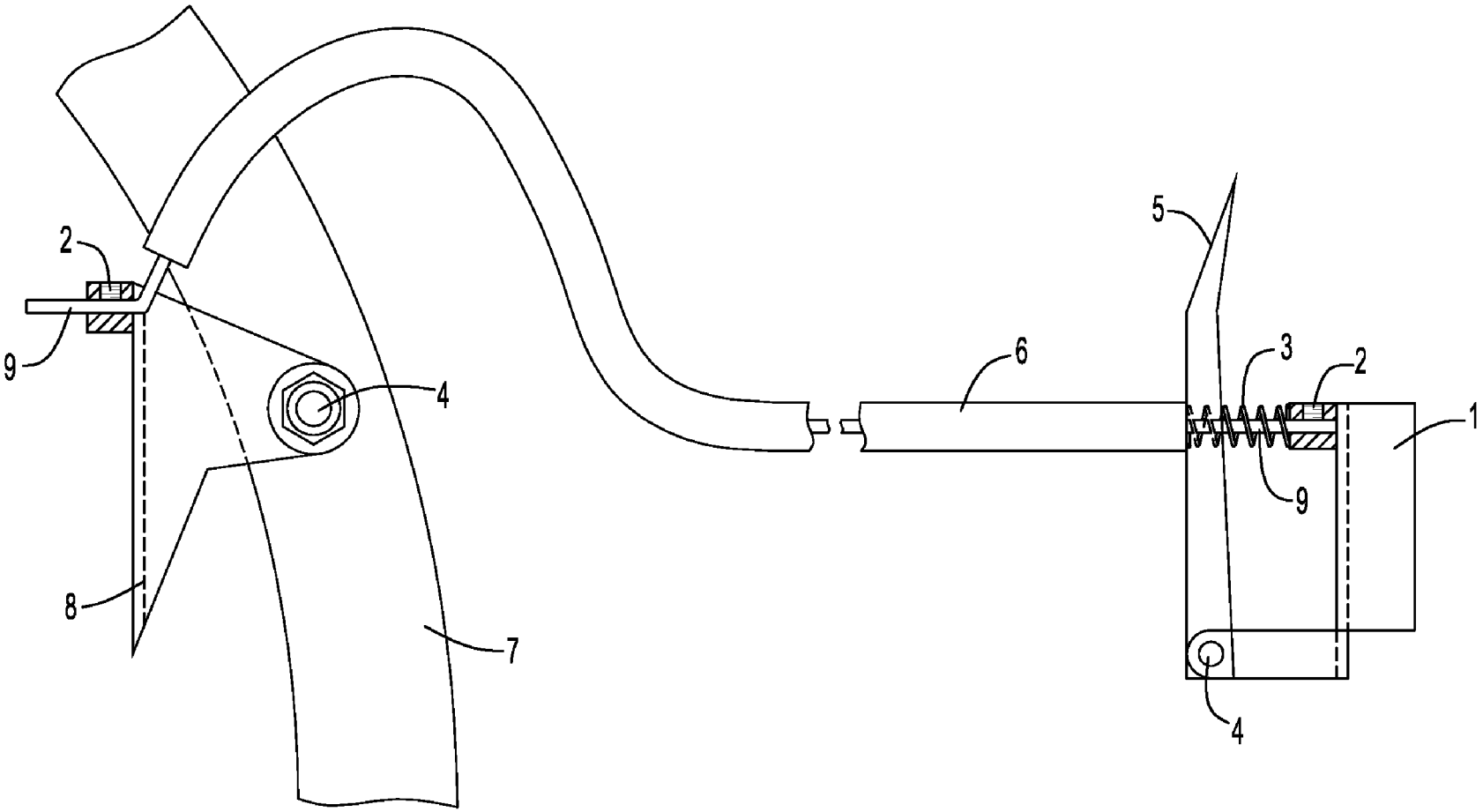
FIG. 1 is a broken assembly view of the remote switch actuator showing a portion of a handle bar end including one end of a cable and also showing portion of the drill end including switch actuator and the other end of the cable.
Figure 2A:
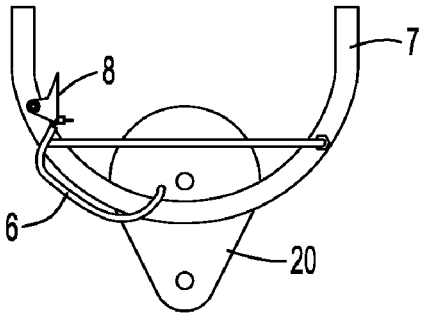
FIG. 2A is a top view of the remote switch actuator of FIG. 1.

FIG. 1 shows a portion of a U-shaped handle bar 7 (complete handle bar 7 is also shown in FIG. 2A) which is held by the hands of a user during use of the remote actuator device. A first lever or handle bar actuator lever 8 is pivotally secured to the handle bar 7 by a pivot pin 4. Attached to an end of lever 8, via a cable clamp 2, is a first end of a cable 9. The cable 9 also extends to a second lever or switch actuator lever 5 at the drill end of the remote actuator device. The switch actuator lever 5 is pivotally secured at one end, via a pivot pin 4, to a drill handle bracket 1. A substantial portion of cable 9 that is disposed between the two levers 5, 8 is encased in a sheath or housing 6. The second end of the cable 9 extends through a portion of the switch actuator lever 5 that is cantilevered from the pivotally secured end and connects to the drill handle bracket 1 with a cable clamp 2. The two levers 5, 8 and cable 9 are similar in design and operation to brake levers and brake cables that are used on bicycles.

Disposed around a portion of the cable 9 at a location between the switch actuator lever 5 and the drill handle bracket 1 is a return spring 3. The return spring 3 biases the switch actuator lever 5 a selected distance away from the drill handle bracket 1 and also (due to the coupling of the two actuator levers via cable 9) biases handle bar actuator lever 8 at a selected distance from the handle bar 7. When the drill handle bracket 1 is secured to a drill mounting bracket 12 (as shown in FIG. 2B) and the handle bar actuator lever 8 is pressed by the user so as to pivotally move the lever 8 toward the handle bar 7, the cable 9 is pulled in a direction toward the handle bar 7, which results in pivotal movement of the switch actuator lever 5 toward the drill handle bracket 1 (and the handle of a drill mounted with respect to the drill handle bracket 1) as described in further detail below.

Figure 2B:
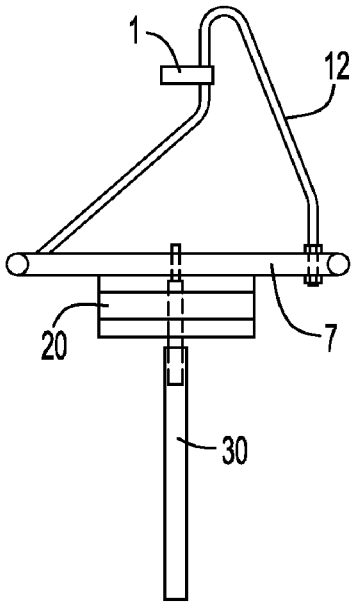
FIG. 2B is a front view in elevation of the remote switch actuator of FIG. 1.
Figure 2C:
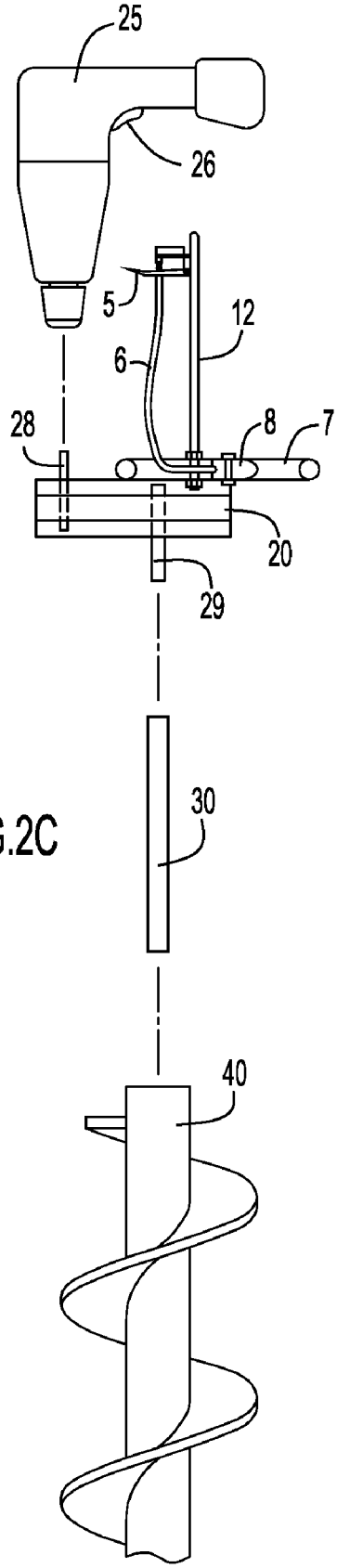
FIG. 2C is a side view in elevation of the remote switch actuator of FIG. 1 including a drill and auger ready to be coupled with the remote switch actuator.

A drill mounting bracket 12 is secured to sections of the handle bar 7 and has a generally looped configuration (as can be seen in FIG. 2B) to facilitate supporting a drill 25 such the rotary chuck end of the drill faces toward an auger 40 to be secured to the device as shown in FIG. 2C. The drill handle bracket 1 is secured to the drill mounting bracket 12 at a suitable location (as shown in FIGS. 2B and 2C) to receive and secure a handle portion of the drill 25 with respect to the drill handle bracket 1 and to further maintain the drill 25 in a proper mounted orientation with respect to the device during use of the device. In this mounted position, an actuation switch 26 of the drill 25 is located in close proximity with the free or cantilevered end of the switch actuator lever 5.

A torque multiplying or amplifying transmission device 20 is secured to the handle bar 7 and includes an input rotary shaft 28 extending from the housing of device 20 that is suitably aligned to engage with the rotary chuck of the drill 25 when the drill 25 is secured to the drill mounting bracket 12 via the drill handle bracket 1 (as shown in FIG. 2C). An output rotary shaft 29 also extends from the housing of the torque amplifying transmission device 20 (on an opposing side of the housing in relation to the side of the amplifying transmission device housing from which input rotary shaft 28 extends) and is configured to connect with an extension shaft 30. The extension shaft 30 connects with a rotary tool such as an auger 40 (as shown in FIG. 2C).

As noted above, when the handle bar actuator lever 8 is pressed by the user so as to pivotally move the lever 8 toward the handle bar 7, the cable 9 is pulled in a direction toward the handle bar 7, which results in corresponding pivotal movement of the switch actuator lever 5 toward the drill handle bracket 1 against the bias of spring 3 (since the drill handle bracket is secured to the drill mounting bracket 12). This causes the switch actuator lever 5 to move toward and engage with the actuator switch 26 of the drill 25. When the user releases the hold on the handle bar actuator lever 8, the bias of spring 3 forces both the handle bar actuator lever 8 and the switch actuator lever 5 back to their original positions outward and their respective distances away from the handle bar 7 and the drill handle bracket 1. This results in a release of the engagement of the switch actuator lever 5 with the drill actuator switch 26, which deactivates or shuts off the drill 25.

Any suitable drill 25 can be used with the actuator device of the invention. It is preferable to use any conventional cordless drill 25, since use of the device is typically in environments more suitable for use with a cordless drill. It is further preferable that the actuation switch 26 of the drill 25 is of the conventional type that turns the drill on and off by applied force and corresponding release of force upon the switch 26.

In use, the user mounts a drill 25 to the device using the drill mounting bracket 12 and drill handle bracket 1, and further connects the rotary chuck of the drill 25 with the input rotary shaft 28 of the amplifying transmission device 20. In addition, the output rotary shaft 29 is secured to an auger 40 via the extension shaft 30. The user places the auger on a surface. In an example embodiment, the auger is an ice auger used to drill holes in ice on frozen lakes or other bodies of water (used, e.g., by fishermen in the winter). The user can keep both hands on the handle bar 7 while simultaneously actuating the drill 25 by pressing the handle bar actuator lever 8 (which results in actuation of the drill 25 in the manner described above). Rotation of the drill chuck causes rotary motion of the input rotary shaft 28 and a corresponding rotation with amplified torque on output rotary shaft 29 (based upon the action of the amplifying transmission device 20), which in turn results in a rotary motion of the auger 40 as it is forced downward upon the surface by applied pressure by the user to the handle bar 7. When the user decides to stop rotation of the auger 40, the user simply releases his or her hand from the handle bar actuator lever 8, which deactivates (or turns off) the drill 25.

Thus, the remote actuator device of the invention facilitates safe operation of the device, allowing the user to control the device with both hands maintained on the handle bar 7 while remotely actuating a drill mounted to the device via the handle bar actuator lever 8.

What is claimed is:

1. A remote switch actuator assembly comprising:

a handle bar;

a first actuator lever mounted to the handle bar;

a mounting bracket configured to secure a drill to the handle bar such that a chuck end of the drill faces the handle bar;

a second actuator lever secured to the mounting bracket so as to be in proximity with an actuation switch of the drill when the drill is secured by the mounting bracket; and a cable extending between and coupled with the first actuator lever and the second actuator lever;

wherein the first actuator lever is movable with respect to the handle bar to effect movement of the cable and corresponding movement of the second actuator lever toward the mounting bracket and the actuation switch of the drill when the drill is secured by the mounting bracket, and movement of the second actuator lever facilitates actuation of the drill secured by the mounting bracket by engaging with the actuation switch of the drill in response to movement of the first actuator lever.

2. The remote switch actuator assembly of claim 1, further comprising a spring that biases the second actuator lever to a first position located a selected distance from the mounting bracket and also the first actuator lever to a second position located a selected distance from the handle bar, wherein a force is applied to move the first actuator lever with respect to the handle bar to effect movement of the cable toward the handle bar and corresponding movement of the second actuator lever toward the mounting bracket and, upon release of the force applied to move the first actuator lever, the spring biases the second actuator lever to its first position and the first actuator lever to its second position.

3. The remote switch actuator assembly of claim 1, wherein the handle bar has a U-shape configuration.

4. The remote switch actuator assembly of claim 1, further comprising connection structure configured to connect a chuck portion of the drill with an auger such that rotary motion of the chuck portion of the drill effects rotary motion of the auger.

5. The remote switch actuator assembly of claim 4, wherein the connection structure comprises a torque amplifying transmission, the torque amplifying transmission including an input rotary shaft to connect with the chuck portion of the drill when the drill is secured to the mounting bracket and an output rotary shaft to connect with the auger.

* * * * *